US007233295B2

(12) United States Patent
Regala

(10) Patent No.: US 7,233,295 B2
(45) Date of Patent: Jun. 19, 2007

(54) CONFORMAL DRIVESHAFT COVER SATCOM ANTENNA

(76) Inventor: Florenio Pinili Regala, 3097 Klondike Ave., Costa Mesa, CA (US) 92626

( * ) Notice: Subject to any disclaimer, the term of this patent is extended or adjusted under 35 U.S.C. 154(b) by 202 days.

(21) Appl. No.: 11/120,337

(22) Filed: May 3, 2005

(65) Prior Publication Data

US 2006/0250317 A1 Nov. 9, 2006

(51) Int. Cl.
*H01Q 1/28* (2006.01)
*H01Q 1/38* (2006.01)

(52) U.S. Cl. ..... 343/705; 343/700 MS; 343/793

(58) Field of Classification Search ..... 343/700 MS, 343/803, 792–797, 705

See application file for complete search history.

(56) References Cited

U.S. PATENT DOCUMENTS 3,789,416 A * 1/1974 Kuecken et al. ..... 343/792
5,554,997 A * 9/1996 Cobb ..... 343/793
2006/0250317 A1* 11/2006 Regala ..... 343/795

OTHER PUBLICATIONS

Dayton-Granger Inc., Ft. Lauderdale, FL., Sikorsky "Blackhawk" Program; p. 215; www.daytongranger.com, no date.

* cited by examiner

*Primary Examiner*—Trinh Vo Dinh
(74) *Attorney, Agent, or Firm*—Mayback & Hoffman, P.A.; Scott D. Smiley

(57) ABSTRACT

An antenna assembly (700) includes a set of conformal shells (704, 706) housing a set of orthogonal dipoles (102, 104, 108, 110) that produce a circularly polarized radiation pattern. The dipoles (102, 104, 108, 110) are fed by a quadrature hybrid (118) and impedance matching circuit (114). The assembly (700) also includes a set of baluns (126, 128) to reduce VSWR.

20 Claims, 9 Drawing Sheets

Circular Polarization - E Field

CONFORMAL DRIVESHAFT COVER SATCOM ANTENNA

BACKGROUND OF THE INVENTION

1. Field of the Invention

This invention generally relates in general to conformal antennas and more particularly, to a satellite-communication antenna that is integrated with a curved horizontal-driveshaft cover of a helicopter.

2. Description of the Related Art

Wireless communication is accomplished through use of a radio connected to an antenna. An antenna is an impedance-matching device used to absorb or radiate electromagnetic waves into the atmosphere. The function of the antenna is to "match" the impedance of the propagating medium, which is usually air or free space, to the source of the radio waves, i.e., output of the radio.

Antennas are available in many different shapes and sizes. The particular shape and size of an antenna designed for a particular application depends on many factors, such as the operating frequency range, the expected environment the antenna will endure, size limitations, shape of the structure the antenna is to be installed upon, adjacent structures and materials, power efficiency, power limitations, impedance requirements, Voltage Standing Wave Ration (VSWR) requirements, application particulars, and many more.

One common use of antennas is on vehicles, either airborne or terrestrial. An antenna can be placed on various locations on the body of the vehicle, providing communication between the vehicle and other radio-wave-receiving entities, such as handhelds, base stations, other vehicles, and more. The communication links include ground to air, air to ground, air to air, and ground to ground.

All vehicles, whether airborne or terrestrial, have a finite amount of exterior surface area, often referred to as "real estate," in which antennas can be placed. Antennas that are installed on the exterior of these vehicles must withstand heavy torque from wind and debris, resist moisture, withstand extreme and rapid temperature changes, heavy vibrations, and other environmental hazards. Additionally, the shape of the body, especially in airborne vehicles, provides functionality. Therefore, it is advantageous for antennas mounted on airborne vehicles to not alter the shape of the body.

Helicopters are commonly-used non-fixed-wing aircraft that are able to take off and land vertically and travel at high speeds while airborne. A helicopter consists of a main body section that holds the pilot and other passengers, the engine and the main rotor. The main rotor is a blade that spins generally parallel to the ground and produces a spinning torque on the main body section opposite the direction of rotation of the rotor. To counter the torque produced by the rotor, helicopters have a tail section with a second rotor that is oriented generally perpendicular to the ground and perpendicular to the main rotor. The second rotor spins and produces a force that counteracts the spinning torque of the main rotor and prevents the main body from spinning out of control.

Connecting the engine to the second rotor is a drive shaft. The drive shaft travels above and along the length of the tail section to the second rotor. Because the driveshaft spins, it is advantageous to provide a cover over the shaft to prevent dirt, moisture, and debris from contacting the shaft. To serve this purpose, a driveshaft cover, which consists of one or more sections, is attached to the tail section on either side of the driveshaft so that it encloses the driveshaft. The driveshaft cover is generally made of fiberglass or other composite material and provides a relatively large amount of surface area or "real estate." However, until now, the space along the driveshaft cover has not been utilized other than for simply covering the driveshaft.

Communication with those on the ground is most easily accomplished with radiating elements commonly called "monopoles" or "dipoles." A dipole has two elements of equal size arranged in a shared axial alignment configuration with a small gap between the two elements. Each element of the dipole is fed with a charge 180 degrees out of phase from the other. In this manner, the elements will have opposite charges and common nulls. A monopole, in contrast, has only one element, but operates in conjunction with a ground plane, which mimics the missing second element. The physics of monopoles and dipoles are well known. Monopoles and dipoles, however, are efficient only for line-of-sight (LOS) communication. Obstructions such as mountains, or great distances, relative to the curve of the earth's surface, between the transmitter and receiver can prevent the reception of these signals. The relative positions of the transmitter and receiver, as well as the power output of the transmitter thus control whether the LOS signal will be received. Additionally, because of the radiation pattern of an LOS transmitter/receiver, communication between two positions that have a great variance in altitude, such as from the ground to the sky above, are not efficient with a monopole or dipole.

To overcome the effect of LOS obstacles, satellite communication (SATCOM) has been developed. Satellites are transceivers that orbit the Earth and can relay communications back and forth from any position near the earth, whether to terrestrial or airborne, or to other satellites, allowing communication virtually anywhere between the Earth's surface and the orbiting satellites.

One of the characteristics of antenna transmission is "polarization," which describes what physical plane the signal is being transmitted in. A dipole or monopole oriented in a vertical position (perpendicular to the earth's surface) radiates signals with a vertical polarization. For a second antenna to receive maximum signal strength, it too must have a vertical orientation. As the receiving antenna is rotated away from vertical, its maximum receive power diminishes to −3 dB (50%) at 45° and 135° and −∞ dB (0%) at horizontal orientation (perpendicular to the transmit antenna).

Because satellites orbit the earth and transmit to receivers in multiple directions and orientations, single plane transmission is not efficient. Therefore, satellites transmit signals in a "circular" polarization. In this manner, the signal is transmitted in a continuous right-hand rotating orientation.

A circularly polarized antenna transmits and receives signals in a circular polarization. The antenna has two dipoles arranged orthogonal to one another. The dipoles alternate "firing" with a positive charge rotating sequentially around the four individual elements and a negative charge on its axially oppositely aligned second element. When viewed on a three-dimensional time vs. polarization graph, the circularly polarized signal resembles a helix.

The transmission path of the circularly polarized signal radiated from the two linear dipoles is substantially perpendicular to the intersecting axis of the crossed dipoles. In other words, the beam width of the crossed dipoles is relatively narrow. As the receiving antenna moves away from this perpendicular alignment relative to the dipoles, i.e., the narrow radiation beam, its maximum receive power diminishes. Therefore, these types of antennas suffer from the shortcomings of having narrow-angle maximum communication efficiency ranges.

Accordingly, a need exists to overcome the shortcomings with the prior art and to provide a dual-band/dual-element antenna with a single connector that also provides adequate isolation between frequency bands.

SUMMARY OF THE INVENTION

Briefly, in accordance with the present invention, disclosed is an antenna assembly that includes an antenna assembly having an arcuate-shaped dielectric substrate formed to fit a horizontal-driveshaft cover of a rotor assembly in a non-fixed-wing aircraft. The antenna assembly has a set of arcuate-shaped dipoles disposed on the dielectric substrate to conform to the arcuate shape thereof. The arcuate-shaped dipoles transceive an electromagnetic radiation pattern at a larger angle from a line perpendicular to a lengthwise dimension of the horizontal-driveshaft cover than an electromagnetic radiation pattern transceived by a set of substantially co-planar dipoles of a length equal to a length of the arcuate dipoles and placed in a plane parallel to the lengthwise dimension of the horizontal-driveshaft cover.

In one embodiment of the present invention, the antenna assembly is attached to a concave inside-surface of the horizontal-driveshaft cover. In another embodiment, the antenna assembly is attached to a convex outside surface of the horizontal-driveshaft cover. In yet another embodiment of the present invention, the arcuate-shaped dipoles are disposed within a layer of the horizontal-driveshaft cover.

In an exemplary embodiment of the present invention, the antenna assembly includes an electrical connector, an impedance-matching circuit, and a quadrature hybrid circuit disposed between the electrical connector and the impedance-matching circuit In further embodiments of the present invention, the antenna assembly includes a balun assembly in electrical communication with the impedance-matching circuit

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention, in which.

DETAILED DESCRIPTION

Figure 1:
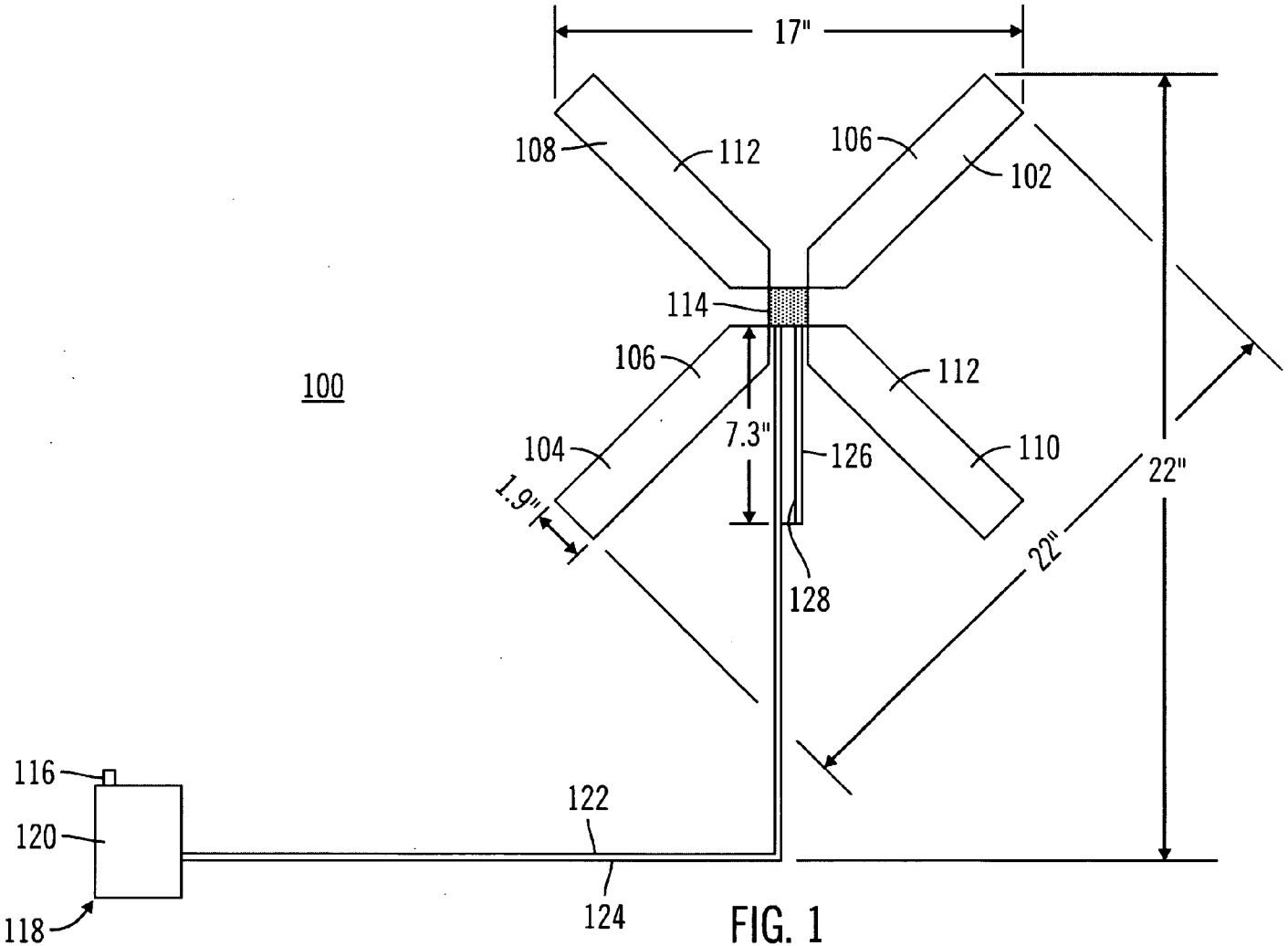
FIG. 1 is a functional block diagram illustrating electrical components of the inventive antenna assembly according to an embodiment of the present invention.

While the specification concludes with claims defining the features of the invention that are regarded as novel, it is believed that the invention will be better understood from a consideration of the following description in conjunction with the drawing figures, in which like reference numerals are carried forward.

The present invention, according to an embodiment, overcomes problems with the prior art by providing an antenna assembly that conforms to, and becomes part of, the body of an aircraft thereby conserving space and having little or no negative effect on the aerodynamics of the aircraft. Additionally, the shape of the antenna provides an advantageously wide cross-polarized radiation pattern.

Described now is an antenna configuration, according to an exemplary embodiment of the present invention. The present invention is a conformal antenna assembly that is integrated either into or onto a portion of a horizontally oriented rear driveshaft cover for a helicopter. The present invention can also be used for other similar applications. The antenna assembly includes a set of orthogonal dipole elements etched on a circuit board or other suitable organic or inorganic medium and sandwiched by fiberglass, composite, or other suitable outer shells. The shape of the assembly is concaved so that the antenna can fit on or beneath a cover that fits around a driveshaft. The two elements are excited by a signal fed by a 90° hybrid and a feed network and matching circuitry. Additionally, the concaved shape advantageously provides a broader radiation pattern for the antenna.

With reference to FIG. 1, a functional block view of the present invention is shown. Dipoles are known in the art and consist of a pair of monopoles axially aligned with one another and each fed with a charge of opposite polarity from that of the other. In the schematic of FIG. 1, monopoles 102 and 104 form dipole 106. Similarly, elements 108 and 110 form dipole 112. As shown in the schematic view of FIG. 1, and as in actual practice, the two dipoles 106 and 112 are arranged orthogonal to each other. The elements can take many shapes and the present invention is not limited to those shown in FIG. 1.

Also shown in FIG. 1 are exemplary physical dimensions of the components of the circuit 100. It should be noted that the dimensions given are for a single embodiment and other alternative dimensions are possible and are within the true spirit and scope of the invention. It should also be noted that the dimensions given are for the components on a flat dielectric material. One such material can be a common printed circuit board having a thickness of 0.02 inches, so that the board can be easily bent to fit within an arcuate shell, as will be explained below.

As is known in the art, the length of the dipoles is dependent on the intended frequency range of the antenna. Typically, elements are chosen to be ¼ or ⅛ of a wavelength of the center frequency within a band of intended frequencies. The present invention is intended to be operated in the Satellite Communication (SATCOM) frequency range, which is 244–318 MHz.

Figure 2:
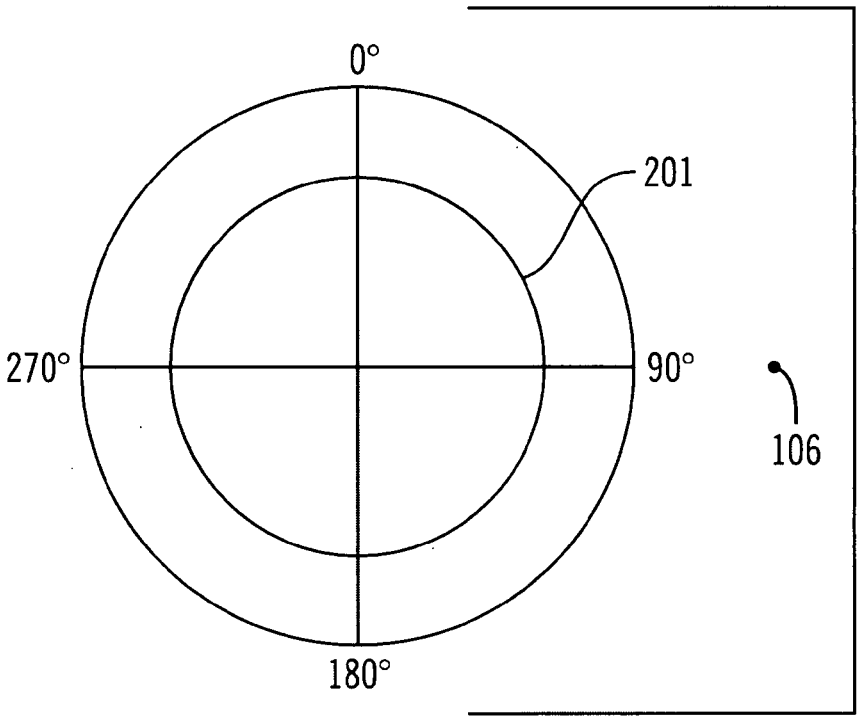
FIG. 2 is an elevational view illustrating a radiation pattern of the inventive antenna assembly according to an embodiment of the present invention.
Figure 3:
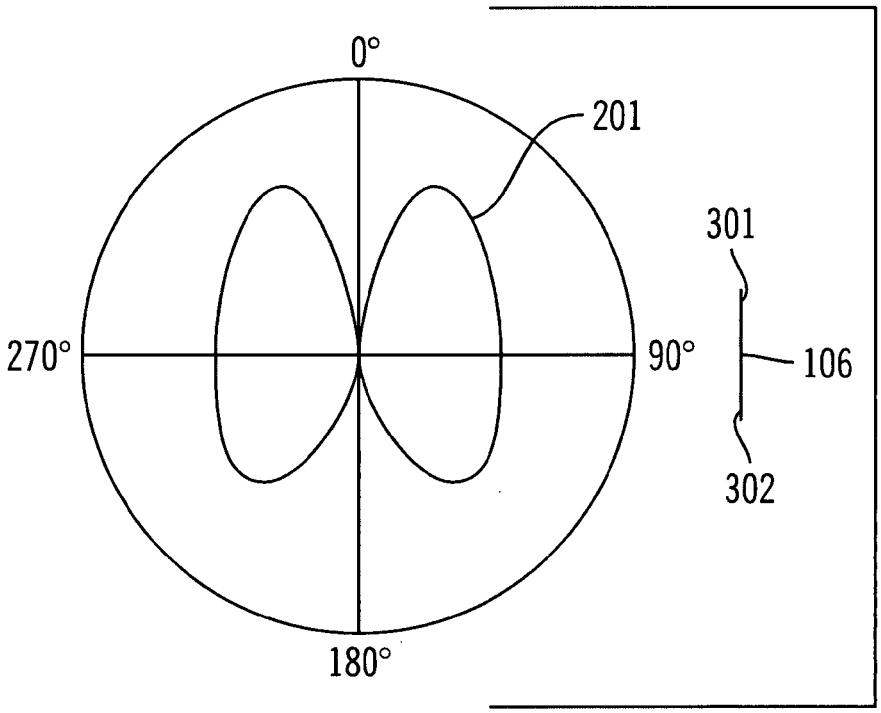
FIG. 3 is a side-view of FIG. 2, illustrating a radiation pattern of the inventive antenna assembly according to an embodiment of the present invention.

For illustrative purposes, a radiation pattern 201 of a dipole antenna, such as dipole 106 of FIG. 1, is shown in FIGS. 2 & 3. FIG. 2 shows the pattern 201 of the antenna 106 from an axial end view. FIG. 3 shows the pattern of the antenna 106 viewed from a broad side of the element with a first end 301 of the antenna 106 oriented in a direction toward 0 degrees and a second end 302 of the antenna 106 oriented in a direction toward 180 degrees. Although the patterns would be produced by the antenna 106 being at the center of the graphs, for illustrative purposes, a dot depicting the orientation of the antenna 106 is pictured on the right side of FIG. 2 and a line depicting the orientation of antenna 106 is pictured on the right side of FIG. 3.

Continuing further, FIG. 2 illustrates the top-view radiation pattern 201, referred to as "omnidirectional", of the antenna 106 is shown. In the perspective of FIG. 2, looking down the axis of antenna 106, the radiation pattern is substantially uniform throughout all angles. In this mode, the antenna communicates equally well in all lateral directions. As previously stated, FIG. 3 shows antenna 106 from a side view. This view shows that radiation strength, also called "gain," decreases from a maximum value at approximately 90 degrees and 270 degrees to a value of approximately zero, referred to as a "null," at approximately 0 degrees and 180 degrees.

When placed in an orthogonal orientation, as shown in FIG. 1, the orthogonal dipoles 106 and 112 alternate "firing" with a positive charge rotating sequentially around the four individual elements 102, 104, 108, and 110 and a negative charge on their axially opposing element. Therefore, each dipole 106 and 112, alternately and continuously reverses polarization.

Figure 4:
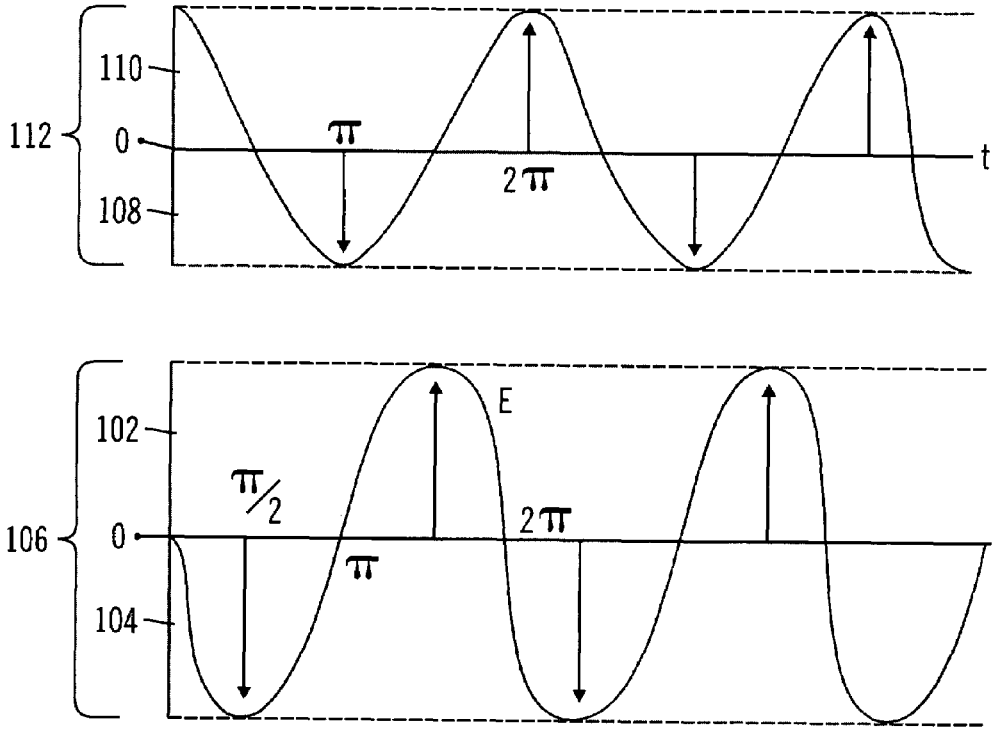
FIG. 4 is a set of graphs illustrating a 90° phase difference between the two dipoles of the inventive antenna assembly according to an embodiment of the present invention.

FIG. 4 shows a graph of an electric field emitted from dipole 106, which includes elements 102 and 104, versus time. Also shown in FIG. 4 is a graph of an electric field emitted from dipole 112, which includes elements 110 and 108, versus time. As shown in FIG. 1, a signal that is fed through the connector 116 will pass through the hybrid 118 and then to the elements. Comparing the two graphs, it can be seen at any given time, that the dipoles 106 and 112 are always 90° out of phase. This phase difference is the product of the input signal routed through the 90° hybrid 118 that splits the input signal into two separate signals, a first sent down transmission line 122 and a second down transmission line 124, with a phase difference of 90°. The result is a positive charge that continuously rotates around the elements.

Specifically, and with reference to the element placement shown in FIG. 1, at a given time 1, a positive charge is applied to element 102 and a negative charge of equal magnitude will be applied to element 104. At time 2, a positive charge will be applied to element 110 and a corresponding negative charge to element 108. At time 3, a positive charge will be applied to element 104, with the corresponding negative charge applied to element 102. Finally, to complete one rotation, a positive charge is applied to element 108 and a corresponding negative charge is applied to element 110. In this manner, a positive charge can be visualized rotating around the circumference of the antenna, in the order 102, 110, 104, and 108.

Figure 5:
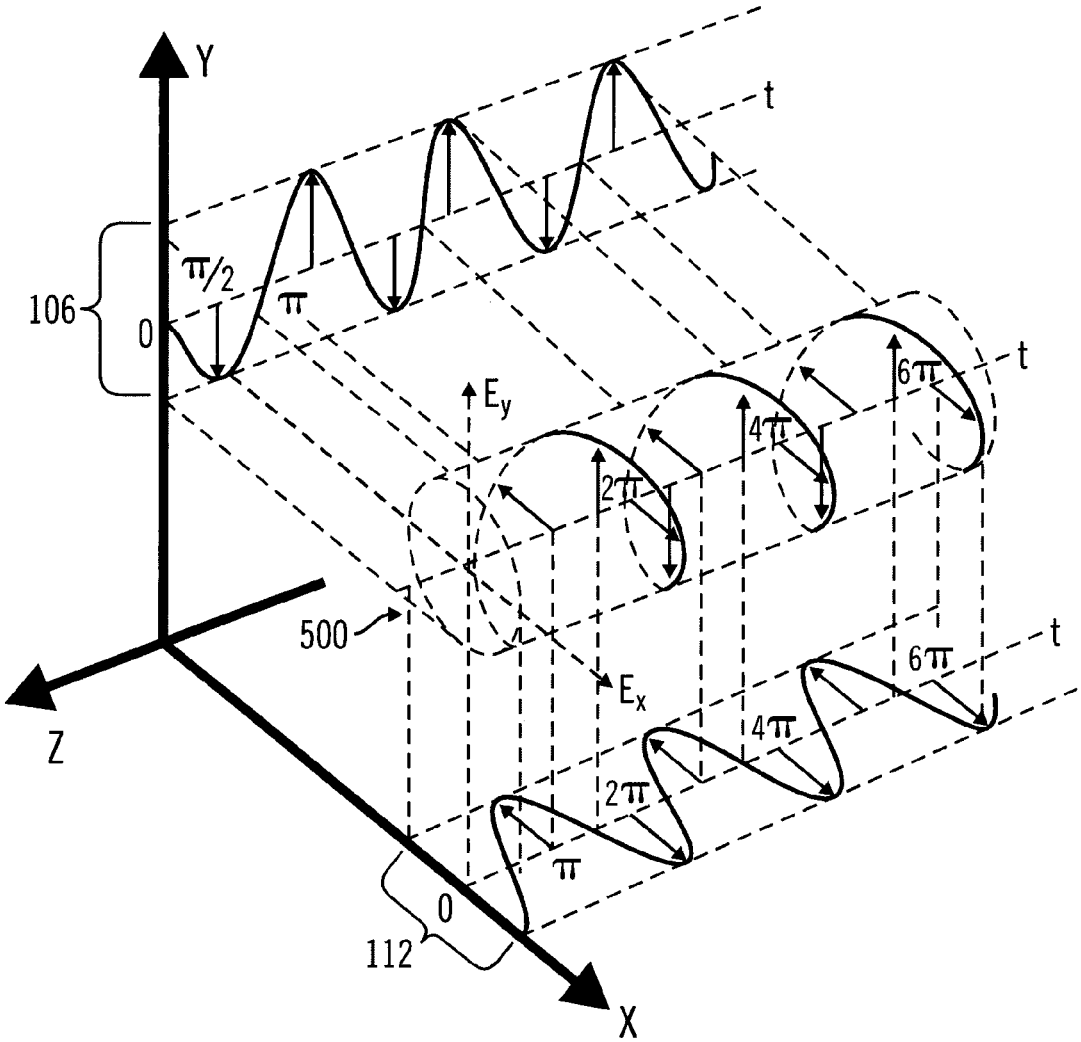
FIG. 5 is a graph combining the two graphs of FIG. 4 and showing the circularly polarized radiation pattern of the inventive antenna assembly according to an embodiment of the present invention.

Turning now to FIG. 5, a graph combining the two graphs of FIG. 4 and showing the resulting circularly-polarized wave produced by the radiating fields of the two orthogonal elements 106 and 112 is illustrated. In this exemplary embodiment, one of the dipoles 106 is oriented along the Y-axis and the other dipole 112 is oriented along the X-axis, the electric fields $E_y$ and Ex, respectively, of the two dipoles 106 and 112 add to produce a circularly polarized radiation pattern 500 that resembles a helix. The result is that, irregardless of the orientation of a second antenna, either omni directional or cross-polarized, reception will be possible at least a portion of each period, 2 times phi (Π).

Referring back to FIG. 1, for the most efficient radiation and reception of RF signals, a feed network and impedance matching circuit 114 is provided between a radio/antenna interface (RF connector) 116 and the radiating elements 102, 104, 108, and 110. The function of the impedance matching network is to "match" the antenna impedance of each element to the impedance of the propagating medium, which is usually air or free space. The feed network and matching circuit 114 connect and feed signals to the dipoles 106 and 112. Matching circuit 114 includes inductive and capacitive elements, which are well known in the art. Therefore, impedance matching and particulars of such circuits will not be further discussed herein.

Located between the impedance-matching circuit 114 and radio/antenna interface 116 is a 90° quadrature hybrid 118 and a terminating load. Quadrature hybrids are circuits that separate a single input signal into two output signals with a relative phase difference, in this case, 90°. Hybrids are well known in the art. Therefore, terminations, hybrids, and particulars of such circuits will not be further discussed herein.

Connecting the 90° quadrature hybrid/terminating load 118 and the feed network/matching circuit 114 is two lengths of transmission line 122 and 124, which are preferably semi-rigid coaxial cables, such as part number UT-085, available from Micro-Coax, Inc. at 206 Jones Blvd. Pottstown, Pa. 19464–3465. The transmission lines 122 and 124 are conductive pathways that are insulated from and run within an outer conducting jacket. Coaxial cables are advantageous because they provide high levels of isolation to the signal-carrying center conductors by prevent stray electromagnetic signals from entering or exiting the conductors. Semi-rigid cables also offer the advantage of solderability to their outer jackets. The metallic outer jackets, usually made of aluminum or copper, can be securely affixed to a supporting material by soldering or spot-welding the jacket surface. The center conductor and jacket are isolated from each other by a dielectric insulating material that runs throughout the length of the cable.

Also attached to the feed network/matching circuit 114 and then to the jacket of the transmission lines 122 and 124 is a balun assembly that includes a set of baluns 126 and 128. In an exemplary embodiment, the baluns are each 7.3 inches in length, but other lengths have been shown to be used advantageously with the present invention. Baluns are well known in the art as a way of reducing the voltage standing wave ratio (VSWR) on the transmission lines. Therefore, there is no need to describe any further details of baluns herein.

Figure 6:
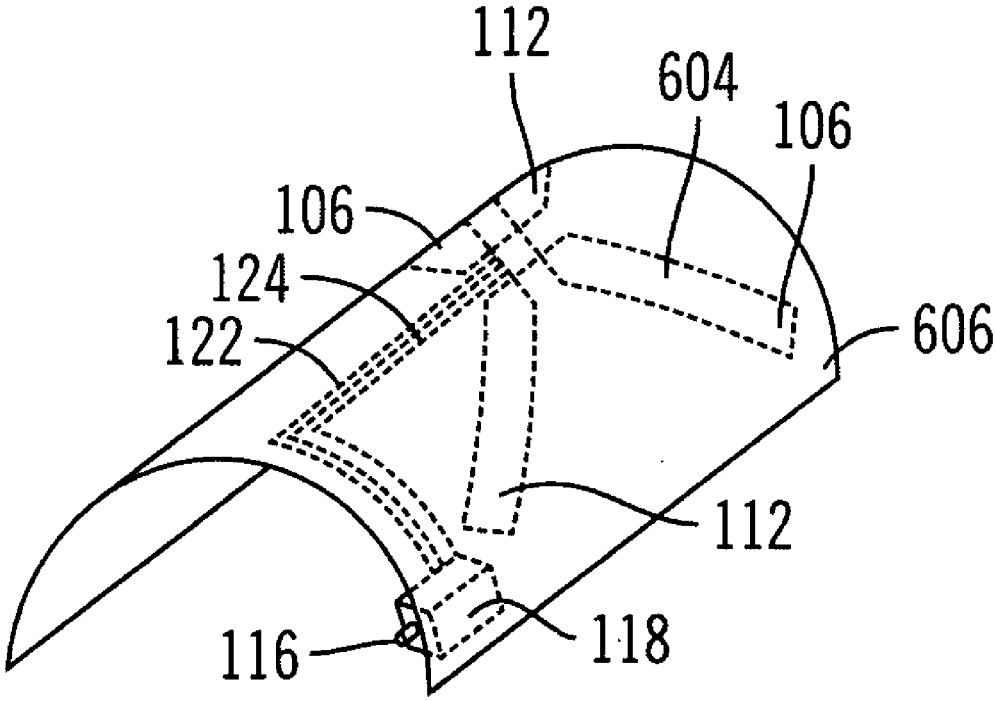
FIG. 6 is a diagram illustrating the electrical components of FIG. 1 applied to an arcuate circuit-supporting dielectric material that can be placed inside a radome, according to an embodiment of the present invention.

Referring now to FIG. 6, the dipoles 106 and 112 (previously shown in FIG. 1) are realized by etching or otherwise placing metallic areas 604, called "elements," on a circuit-supporting dielectric material 606. A few exemplary dielectric materials are fiberglass, plastic, and RT/Duroid, among others. The conductive material 604 is any metallic material or a combination of various metallics, including both organic and inorganic materials suitable for radiating and receiving electromagnetic energy. The purpose of the dielectric material 606 is to provide support for the layer of conductive material 604 attached to the dielectric material 606 so that the circuit can be placed inside of other structures, such as a radome, and the circuit will maintain its shape and dimensional relationship to the components.

When the conductive material 604 is energized with a varying voltage signal, electromagnetic energy is radiated from the conductive material (or in the alternative, the electromagnetic energy is collected with it) forming an antenna to enable wireless communication. As is understood in the relevant arts, the receive and transmit characteristics of RF antennas are essentially identical. It is therefore understood that references to or descriptions of either one of the receive or the transmit characteristics of an antenna apply to both the receive and transmit characteristics of that antenna.

As can be seen in FIG. 6, the dielectric material 606 is downwardly curved. In one embodiment of the present invention, the conductive material 604 is disposed on only the inside concaved surface of the dielectric material 606. Also on the concave side of the dielectric material is a connector 116 for attaching a radio to the antenna assembly. The connector 116 is mounted on the box 120 on the inside of the curved dielectric 606, which houses the quadrature hybrid circuit 118. A signal received from a radio is fed into the hybrid 118. Examples of connector types are BNC, TNC, N-Type, and SMA. Other types of connectors are contemplated may be used without departing from the true spirit and scope of the invention.

Figure 7:
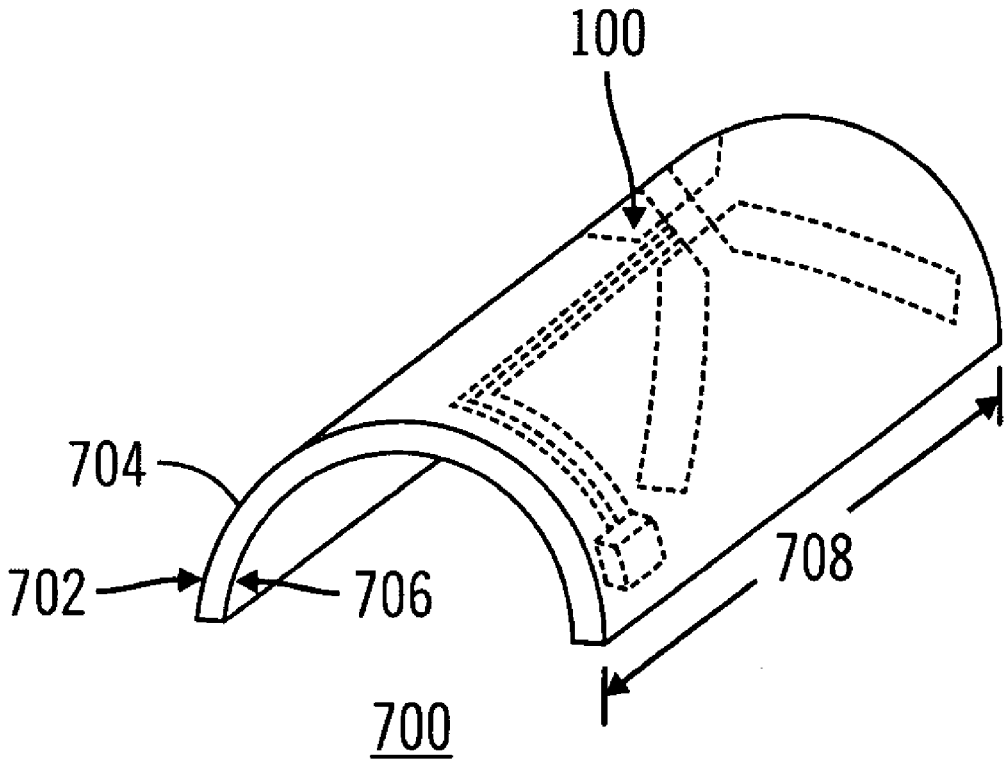
FIG. 7 is a diagram illustrating the electrical components of FIG. 1 within the inventive antenna assembly, according to an embodiment of the present invention.

Turning to FIG. 7, the circuit 100 of FIG. 1 is shown positioned within a housing 702, with or without the dielectric substrate of FIG. 6, to produce the inventive antenna assembly 700 according to one embodiment of the present invention. The housing 702 consists of an outer arcuate shell 704 and an inner arcuate shell 706 with a lengthwise dimension 708. In one embodiment of the present invention, the elements are produced on the printed circuit board material or other circuit-supporting dielectric material, such as 606 shown in FIG. 6, by etching or otherwise. The circuit supporting material 606 is then secured between the shells 704 and 706. In another embodiment of the present invention, the circuit 100 is attached directly to the concave side of the outer shell 704. Together, the two shells form a protective container for the circuit. Protective covers for antennas are commonly called "radomes." Radomes and radome materials are well known in the art.

As discussed in the preceding paragraph, the elements can be laminated directly onto or into the inner concave surface of the outer shell 704. If the circuit is attached to a circuit supporting material, the dielectric material 606 can be fastened to either of the shells 704 or 706 by using epoxy, rivets, screws, bolts, placing between layers of laminate, or other fastening means. Because the antenna assembly will be subjected to relatively high magnitude vibrations, it is preferable that the circuit 100, the circuit-supporting material 606 (if used) and the shells 704 and 706 are secured as a unit and do not move relative to one another. Any movement relative to one another can result in disconnection of electrical paths or degradation in performance of the antenna and harm to other components on the aircraft.

In one embodiment, the antenna assembly 700 is fastened to the outside surface of a vertical driveshaft cover. In this embodiment, the outside convex surface of the outer shell 704 is exposed to conditions, such as high-velocity wind, rain, sun, dust, debris, and others. Therefore, the outer shell 704 is preferably made of a durable material. Additionally, electromagnetic waves must be able to pass through the outer shell 704 to the dipoles 106 and 112 of circuit 100. Therefore, at least the outer shell 704 is selected from a material that provides a minimum amount of attenuation to the transmission of electromagnetic waves acting as a durable shell. In one embodiment, the outer shell 704 is made of fiberglass. Other suitable materials are plastic and carbon fiber, among others.

Figure 8:
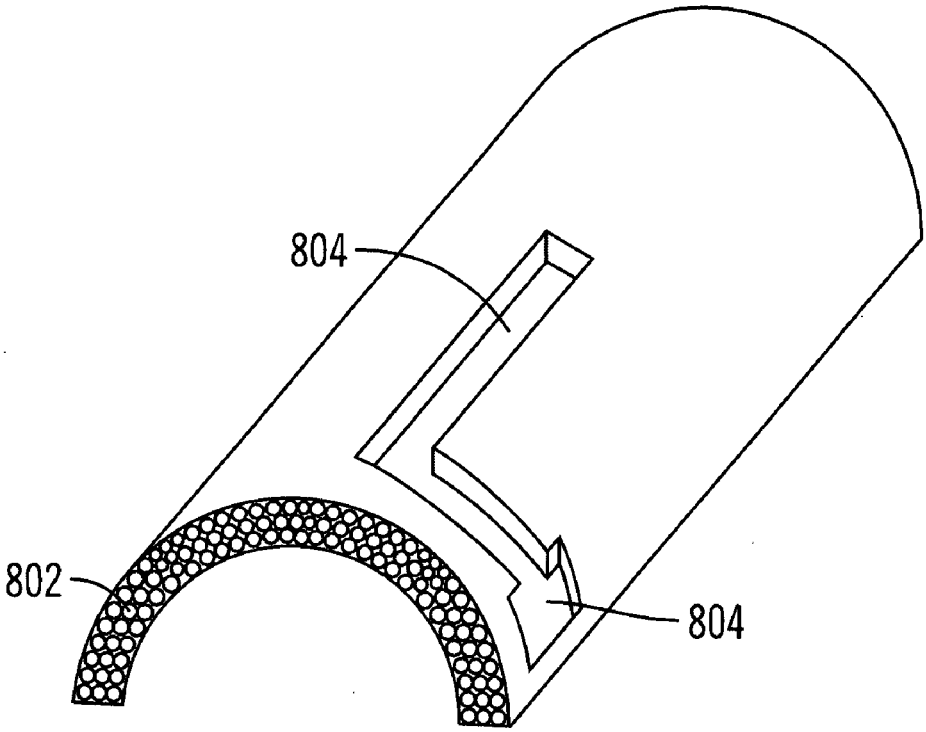
FIG. 8 is a diagram illustrating a radome, according to an embodiment of the present invention.

In an embodiment of the present invention, as is known in the art, strength is added to the housing 702 by providing a honeycomb material between the two shells. The honeycomb material 802 is shown in FIG. 8. Also seen in FIG. 8 are recessed sections 804 within the honeycomb material 802. The recessed sections 804 provide areas that accommodate the feed network 114, baluns 126 and 128, transmission lines 122 and 124, and housing 120 for the quadrature hybrid 118. The components in the recessed sections can be secured by adhesives, foam, hardware and the like.

Figure 9:
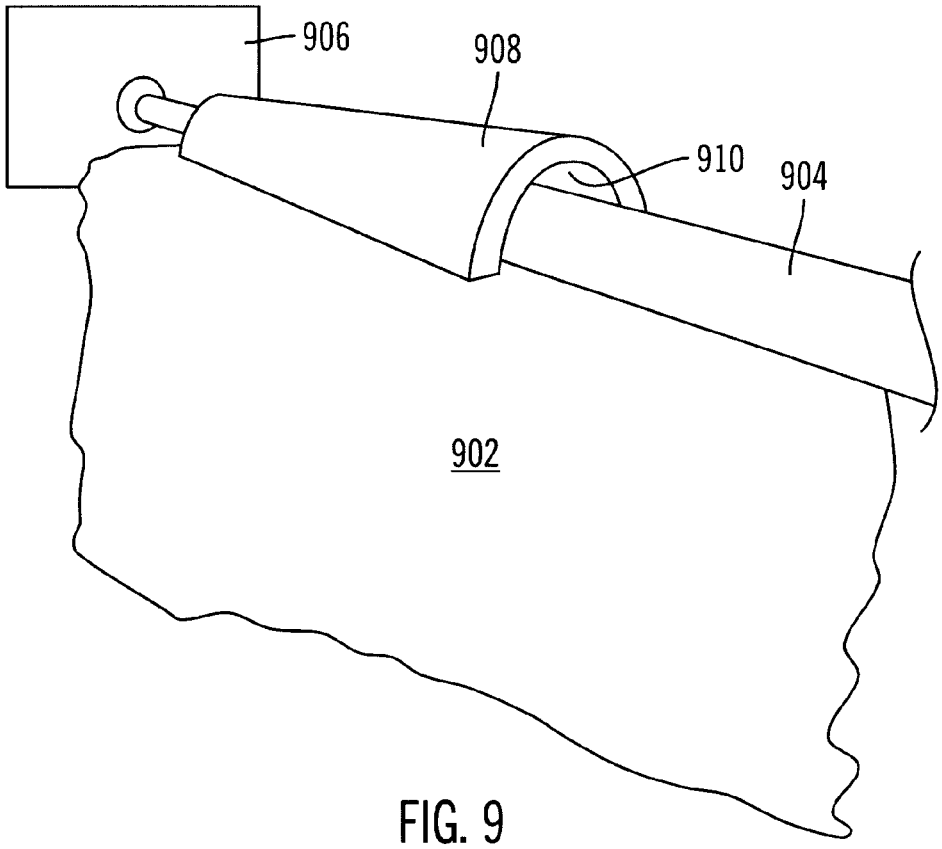
FIG. 9 is a diagram illustrating a helicopter driveshaft and driveshaft cover, according to an embodiment of the present invention.

FIG. 9 shows a portion of a helicopter body 902, which includes a horizontal driveshaft 904 that connects the engine 906 to a tail rotor (not shown). The horizontal driveshaft 904 is located above the tail section 902 of the helicopter. In operation, the driveshaft spins at high velocity. To prevent foreign objects, such as dust and debris, from coming into contact with driveshaft 904, a driveshaft cover 908 is placed over the driveshaft 904. The driveshaft cover 908 can be one piece or several sub-pieces of the entire cover.

The inventive antenna assembly 700 conforms to the curvature of the driveshaft cover 908 and can be attached, by bolting, screwing, or otherwise, the antenna assembly 700 to the outer surface of the driveshaft cover 908. As can be seen in FIG. 9, there is a space 910 between the driveshaft 904 and the inner concave surface of the driveshaft cover 908. If the clearance is in the order of about 2.5 inches or more, the antenna assembly 700 can be attached inside the driveshaft cover 908, while still providing sufficient clearance for the driveshaft 904 to spin freely.

In another embodiment of the present invention, the antenna assembly 700 can be built into the driveshaft cover itself instead of the using the shells 704 and 706. In this embodiment, the driveshaft cover is the radome for the antenna assembly 700.

It should be noted that most driveshaft covers 908 are hinged (not shown) on one side to allow access to the driveshaft for repairs and otherwise. In one preferred embodiment, the antenna assembly 700 is installed so that the connector 116 is on the same side of the driveshaft cover 908 as the hinge. This will prevent the connecting cable, which connects a radio to the antenna 700 via the connector 116, from spanning the opening when the driveshaft cover 908 is opened to access the driveshaft 904.

In another embodiment of the present invention, the shells 704 and 706 forming the housing 702 are not separate pieces, but are instead one continuous covering for protecting and containing the circuit 100 and other components. In this case, the term "shells" refers to at least a first and a second surface of the continuous covering. In yet another embodiment of the present invention, each of the shells 704 and 706 are made of sub-pieces or component coverings. Therefore, the shells 704 and 706 are not limited to any number of individual pieces, but instead refer any configuration, material, or device that provides protection for the antenna elements.

Figure 10:
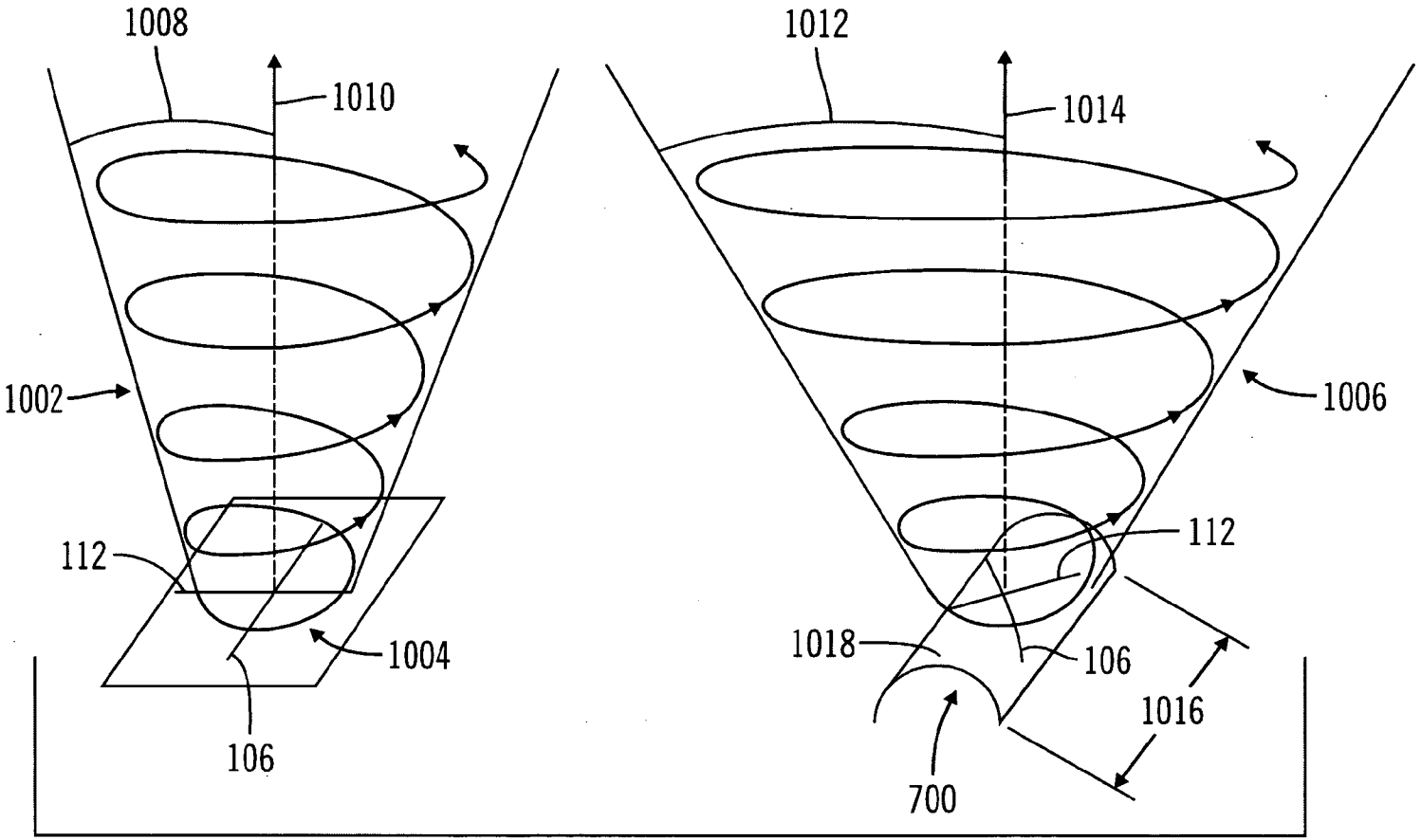
FIG. 10 is a diagram illustrating an improved radiation pattern, according to an embodiment of the present invention.

As an effect of the curved dipoles 106 and 112, the radiation pattern of the antenna 700 has been broadened, as shown in FIG. 10. The first radiation pattern 1002 shows the directivity of the cross-polarized signal when the dipoles 106 and 112 are in a co-planar configuration 1004. As the electromagnetic waves leave the dipoles 106 and 112, the waves expand at an angle 1008 measured from a line 1010 perpendicular to the plane of the dipoles 106 and 112.

A second radiation pattern 1006, is also shown in FIG. 10. The second pattern 1006 shows the much broader radiation pattern of the curved dipoles 106 and 112 in the inventive antenna assembly 700 according to an embodiment of the present invention. In the pattern 1006 of the curved dipoles 106 and 112, the angle 1012, measured from a line 1014 perpendicular to a lengthwise dimension 1016 of the radome 1018 that the dipoles 106 and 112 are attached to. Therefore, the inventive antenna 700 now provides a much larger physical angle of possible communication than a set of co-planer dipoles of a length equal to a length of the arcuate dipoles and placed in a plane parallel to the lengthwise dimension 1016 of the antenna assembly 700.

It should be clear from the above description that the present invention can be used for transmitting as well as receiving. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna assembly, comprising:

an arcuate-shaped dielectric substrate formed to fit a horizontal-driveshaft cover of a rotor assembly in a non-fixed-wing aircraft; and a set of arcuate-shaped dipoles disposed on the dielectric substrate to conform to the arcuate shape thereof, wherein, the arcuate-shaped dipoles transceive an electromagnetic radiation pattern at a larger angle from a line perpendicular to a lengthwise dimension of the horizontal-driveshaft cover than an electromagnetic radiation pattern transceived by a set of substantially co-planar dipoles of a length equal to a length of the arcuate dipoles and placed in a plane parallel to the lengthwise dimension of the horizontal-driveshaft cover.

2. The antenna assembly according to claim 1, wherein the arcuate-shaped dielectric substrate comprises at least one of:

fiberglass;

plastic;

carbon fiber;

RT/Duroid; and composite.

3. The antenna assembly according to claim 1, wherein the fit is against one of:

a concave inside surface of the horizontal-driveshaft cover; and a convex outside surface of the horizontal-driveshaft cover.

4. The antenna assembly according to claim 1, wherein the fit is within a layer of the horizontal-driveshaft cover.

5. The antenna assembly according to claim 1, further comprising:

an electrical connector;

an impedance-matching circuit; and a quadrature hybrid circuit disposed between the electrical connector and the impedance-matching circuit.

6. The antenna assembly according to claim 5, wherein:

the quadrature hybrid circuit is disposed on a concave surface of the arcuate-shaped dielectric substrate.

7. The antenna assembly according to claim 5, further comprising:

at least one balun in electrical communication with the impedance-matching circuit.

8. An antenna assembly, comprising:

a radome formed to fit an arcuate-shaped horizontal-driveshaft cover for a rotor assembly in a non-fixed-wing aircraft; and a set of arcuate-shaped dipoles disposed within the radome and shaped to conform to the arcuate-shaped horizontal-driveshaft cover, wherein, the arcuate-shaped dipoles transceive an electromagnetic radiation pattern at a larger angle from a line perpendicular to a lengthwise dimension of the horizontal-driveshaft cover than an electromagnetic radiation pattern transceived by a set of substantially co-planar dipoles of a length equal to a length of the arcuate dipoles and placed in a plane parallel to the lengthwise dimension of the horizontal-driveshaft cover.

9. The antenna assembly according to claim 8, wherein the set of arcuate-shaped dipoles are formed as one or more layers within the radome.

10. The antenna assembly according to claim 8, further comprising:

a honeycomb material disposed within the radome.

11. The antenna assembly according to claim 10, further comprising:

at least one recessed section disposed within the honeycomb material, the recessed section for accepting the set of arcuate-shaped dipoles.

12. The antenna assembly according to claim 8, wherein the set of arcuate-shaped dipoles are electrically connected so at to transceive a circularly-polarized electromagnetic radiation pattern.

13. A communication system for a non-fixed-wing aircraft having a rotor assembly with a horizontal driveshaft, the communication system comprising:

a radio connected to an antenna assembly, the antenna assembly including:

an arcuate-shaped dielectric substrate formed to fit a horizontal-driveshaft cover of the rotor assembly; and a set of arcuate-shaped dipoles disposed on the dielectric substrate to conform to the arcuate shape thereof, wherein, the arcuate-shaped dipoles transceive an electromagnetic radiation pattern at a larger angle from a line perpendicular to a lengthwise dimension of the horizontal-driveshaft cover than an electromagnetic radiation pattern transceived by a set of substantially co-planar dipoles of a length equal to a length of the arcuate-shaped dipoles and placed in a plane parallel to the lengthwise dimension of the horizontal-driveshaft cover.

14. The antenna assembly according to claim 13, wherein the arcuate dielectric substrate comprises at least one of:

fiberglass;

plastic;

carbon fiber;

RT/Duroid; and composite.

15. The antenna assembly according to claim 13, wherein the fit is against one of:

a concave inside surface of the horizontal-driveshaft cover; and a convex outside surface of the horizontal-driveshaft cover.

16. The antenna assembly according to claim 13, wherein the fit is within a layer of the horizontal-driveshaft cover.

17. The antenna assembly according to claim 13, further comprising:

an electrical connector;

an impedance-matching circuit; and a quadrature hybrid circuit disposed between the electrical connector and the impedance-matching circuit.

18. The antenna assembly according to claim 17, wherein:

the quadrature hybrid circuit is disposed on a concave surface of the arcuate-shaped dielectric substrate.

19. The antenna assembly according to claim 17, further comprising:

at least one balun in electrical communication with the impedance-matching circuit.

20. The antenna assembly according to claim 13, wherein the set of arcuate-shaped dipoles are electrically connected so at to transceive a circularly-polarized electromagnetic radiation pattern.

* * * * *